United States Patent [19]

Ballenger

[11] Patent Number: 4,583,515

[45] Date of Patent: Apr. 22, 1986

[54] ABRASIVE CUTTING WHEEL FOR CUTTING ROCK-LIKE MATERIAL

[75] Inventor: Paul B. Ballenger, Urbana, Mo.

[73] Assignee: Federal-Mogul Corporation, Southfield, Mich.

[21] Appl. No.: 705,411

[22] Filed: Feb. 25, 1985

Related U.S. Application Data

[63] Continuation of Ser. No. 646,041, Aug. 30, 1984, abandoned, which is a continuation of Ser. No. 403,200, Jul. 29, 1982, abandoned.

[51] Int. Cl.[4] ..... B28D 1/04

[52] U.S. Cl. ..... 125/15; 51/206 R; 51/267

[58] Field of Search ..... 51/206 R, 206 P, 267; 125/15

[56] References Cited

U.S. PATENT DOCUMENTS

| | | | |
|---|---|---|---|
| 1,156,166 | 10/1915 | Meyers | 125/15 |
| 1,614,225 | 1/1927 | Bath | 51/206 P |
| 3,128,755 | 4/1964 | Beuson | 51/206 R |
| 4,345,579 | 8/1982 | Eichenlaub | 51/206 R |

FOREIGN PATENT DOCUMENTS

| | | | |
|---|---|---|---|
| 266235 | 2/1927 | United Kingdom | 125/15 |
| 403159 | 12/1933 | United Kingdom | 51/206 P |

*Primary Examiner*—Harold D. Whitehead
*Attorney, Agent, or Firm*—Lawrence J. Shurupoff; Robert F. Hess

[57] ABSTRACT

A circular cutting wheel having a plurality of diamond-bearing arcuately shaped cutting members bonded to the periphery thereof and a gullet between each pair of adjacent cutting members wherein the arc length of each cutting member at its radial extremity is approximately equal to the arc length of an adjacent gullet at its radial extremity and wherein each such gullet has a preferred included angle of approximately 70° between the side faces of the adjacent cutting segments upon which are mounted the diamond bearing cutting members, thereby providing the means with which to pump fluid coolant to the cutting members at the point the cut is being made and to pump the swarf from that same point to an area away from the cutting wheel.

22 Claims, 4 Drawing Figures

ABRASIVE CUTTING WHEEL FOR CUTTING ROCK-LIKE MATERIAL

This application is a continuation of application Ser. No. 646,041, filed 8/30/84 and now abandoned, which is a continuation of application Ser. No. 403,200, filed July 29, 1982 and now abandoned.

BACKGROUND OF THE INVENTION

The present invention relates to abrasive saw blades or cutting wheels and, most specifically to saw blades of the type formed by a strong, circular sheet metal drive core having one or more cutting members containing dispersed diamond dust secured around its periphery by a metallic bond and suitable for serious industrial applications. The invention further includes a method of cutting abradable material such as rock like material, with or without reinforcement members such as steel rod, with a blade of the aforementioned type and using a fluid coolant for cooling the blade and carrying away swarf, principally loose rock-like material and coolant, from the area of the cut being made.

Diamond abrasive saws of the metallic bonded variety have been classicially divided into three distinct groups, all of which are well known in the trade at the present time. The first of these groups is the serrated or notched rim type blade old in the art and probably the earliest concept of the diamond cutting disk or saw. This type of blade is made by notching or slitting a disk of steel or copper and inserting into these fine hacks a paste of diamond grit and a holding material like petroleum jelly or, more recently, various metal powders. The notched rim type of saw has the merit of being reasonably indestructible but cuts so poorly that it has no real acceptance in any serious industrial applications, although it is satisfactory in the case of the lowest priced blades which are used in home hobby type operations such as the lapidary avocation.

The second group of saw blades consists of a cutting disk having around its periphery a continuous annulus of compressed and matured metallic powder containing diamond dust. This blade has been traditionally made by cold molding the metal powder and diamond dust annulus around a steel body and sintering or otherwise maturing the annulus to a sufficient strength to hold the diamond dust well and to cut freely. This type of blade is functionally superior over the first mentioned group of blades, but it too is unsatisfactory for serious industrial applications since it has the disadvantage of being physically frail and liable to injury in usage, due to the delicate nature of the bond between the annulus and the core. Various mechanical devices have been proposed to improve the bond, but in general due to the shortcomings of the manufacturing method, the cutting disk so made is fragile. Its use is confined in large part to precision operations such as germanium cutting, optical glass cutting, and other nice uses that fall more or less into the instrument making classes.

The third and most recent group of saw blades is the discontinuous rim or segmental type. This cutting disk is made by manufacturing a series of short arcuate segments containing diamond powder in a metallic body. These segments are usually about 2 inches long and are ordinarily silver soldered, brazed or welded to the rim of a steel core which has been divided into sections of approximately the segment length by chopping or sawing the rim radially. Without these discontinuities the saw disk could not readily be made owing to the great stresses created in the disk by heating only its periphery. The segmented blade has been accepted by those fields that are prone to give the hardest usage to the blades, such as the concrete sawing and masonry cutting field where rough abrasive cutting is done. For such applications it is common to flush the cutting area continuously during the cutting operation with a fluid coolant in order to keep the blade as cool as possible and to flush from such area loose rock-like material, spent abrasive and the like, all of which in combination with the coolant itself is generally referred to in the art and throughout this description of my invention as "swarf". Even though the construction of this type of blade has been developed to a high point of perfection, blades must commonly be replaced whenever the swarf erodes the steel drive core at the juncture of the cutting members with the core and thus causes undercutting of the cutting members and possible loss of the cutting members. This is particularly the case in certain types of concrete cutting operations. Prior to my invention little or no thought had been given to the idea of utilizing the blade construction itself to create a more effective means of providing greater cooling of the wheel, or delivering coolant to the immediate area or point at which the wheel is making the cut or as a means of flushing the swarf from that portion of the cut or cut groove which overlaps the sides of the wheel as the cut is being made.

SUMMARY OF THE INVENTION

Having in mind the shortcomings of the prior art cutting wheels or at least those intended for applications wherein a fluid is continuously supplied to the blade to cool it and flush the cut, my invention includes a circular cutting wheel having a plurality of diamond bearing arcuately shaped cutting members bonded to the periphery thereof and a gullet between each pair of adjacent cutting members wherein the arc length of each cutting member at its radial extremity is approximately equal to the arc length of an adjacent gullet at its radial extremity and wherein each such gullet has a preferred included angle of approximately 70° between the side faces of the adjacent cutting segments upon which are mounted the diamond bearing cutting members, thereby providing the means with which to pump fluid coolant to the cutting members at the point the cut is being made and to pump the swarf from that same point to an area away from the cutting wheel. My invention also includes a method of cutting an abradable material, such as natural and artificial rock materials. utilizing such a cutting wheel which includes the step of entrapping a certain amount of fluid coolant and pumping it to the area of cut at the leading cutting edge of the wheel and thereafter pumping the swarf from the area of the cut.

Accordingly, an object of the invention is to provide a new and improved diamond abrasive cutting wheel of the kind described.

Another object of the invention is to construct a cutting wheel in such manner as to provide a means for pumping a fluid coolant.

Another object is to provide a cutting wheel capable of more effectively delivering a fluid coolant to the area being cut by the cutting wheel and to portions of the cutting wheel itself.

Yet another object is to provide a diamond abrasive cutting wheel which uses substantially less diamond material than conventionally constructed cutting wheels but has a cutting speed at least equal to any such conventional cutting wheel.

A further object of the invention is to provide a method of cutting rock-like material with a cutting wheel of the kind described in such manner as to provide more fluid coolant in the area of the cut from a given source than has heretofore been known to those skilled in the art.

Yet a further object of the invention is to provide a process of cutting rock-like material using a fluid coolant to cool and flush swath from the cutting wheel and using the cutting wheel itself to increase the cooling and flushing action of the coolant over that heretofore known in the art.

These and other desirable objects may be attained in the manner disclosed as an illustrative embodiment of the invention in the following description and in the accompanying drawings forming a part hereof.

DESCRIPTION OF THE PREFERRED EMBODIMENT

Figure 1:
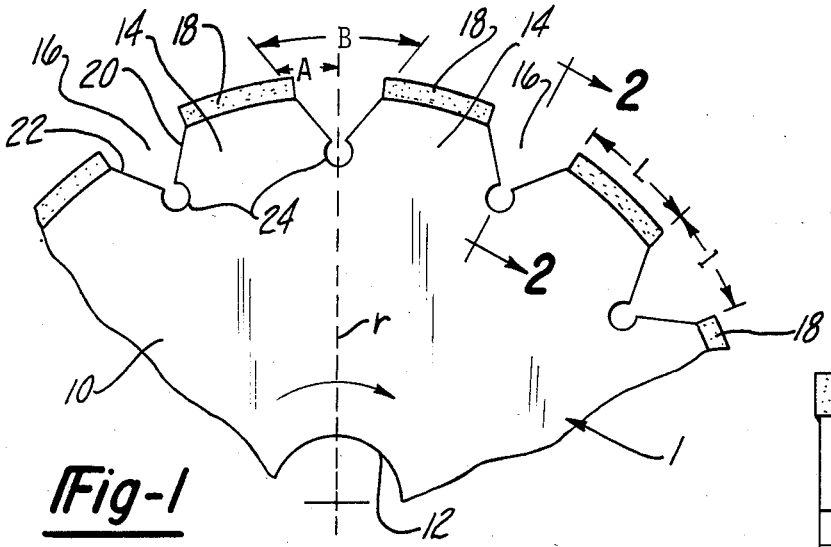
FIG. 1 is a fragmentary face view of a cutting wheel according to a preferred embodiment of the invention.

In FIG. 1 is illustrated a diamond abrasive cutting wheel or blade generally designated as 1 including a central sheet metal drive disk or core 10 made of suitable wrought metal, preferably steel, and provided with a central apparatus or arbor hole 12 for mounting the blade on a rotating shaft. The periphery of the core is segmented so as to provide a plurality of cutting segments 14 and a gullet 16 between each adjacent pair of cutting segments 14. Upon a base or support surface located at the radially extremity of each cutting segment 14 there is bonded a diamond-bearing cutting element or member 18.

Figure 2:
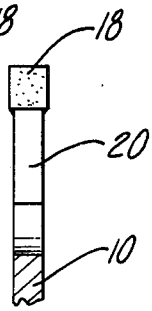
FIG. 2 is a fragmentary radial cross section of the cutting wheel of FIG. 1 taken approximately on the line 2—2 thereof through a gullet.

As viewed from the face of the saw blade, the cutting elements are arcuate. The bases of the cutting segments are circular arcs having the center of the core as their centers of curvature. The cutting members are composed of diamond grit embedded and dispersed in a hard matrix material such as a mixture of bronze and iron. The particular metal mixture mentioned is preferred at the present time, but it is understood that the scope of the invention covers any suitable hard abrasive grit dispersed in any suitable hard mixture material. As seen in FIG. 2, the cutting members 18 are approximately rectangular in cross section and have a slightly greater width than the core 10 to extend outwardly beyond the surfaces of the core 10 by a small equal amount at either side. The diamond bearing elements or sections 18 are wider than the body of the core 10 to provide for clearance during cutting, acting similar to the "set" on a wood or metal cutting saw blade.

Although not shown, the cutting members may overlap the peripheral edge of the core at the bottom edges of the grooves in a radial direction to a small extent. This overlapping contributes to the prevention of undercutting during the rotating operation of the saw blade. In the case of continued use of saw blades of the type here described, difficulties have been encountered with the drive core being worn out at the region of the arcuate junction of the diamond containing cutting members to the core. This wear is caused by the abrasive action of loose abrading particles on the rotating cutting wheel at this region which sharpens and thins the core at this critical peripheral area. This sharpening and cutting of the metallic periphery of the core weakens the bonding junction so as to cause premature breaking off of the cutting members from the core.

The gullets are bounded by respective side faces 20,22 of each adjacent pair of cutting segments. Each pair of side faces 20,22 forming a gullet converges radially inwardly from the base of its respective cutting segment towards an apex. Preferably the gullet is symmetrical about a line r radiating from the center of the blade through the apex such that the angle A between one side face 22 and radial line r is equal to one half of the included angle B between each pair of side faces 20,22 forming a respective gullet. It is preferred that angle B be approximately 70°; however other angles could be used. For example I have found that the cutting wheel will function satisfactorily at an angle B greater than 70° provided one does not reach a point where the wheel "hammers" the material being cut. "Hammering" is the action of a cutting wheel repetitively bouncing off the material surface rather than digging in and cutting it. While I do not recommend decreasing the angle B substantially from the preferred approximate 70°, it is probably possible to do so while still obtaining, but to a lesser degree, the objects of the invention. However, it is known a gullet in the form of a radial slot of narrow width, i.e. an angle B of zero, which is typical of the prior art wheels, will not pump any appreciable amount of coolant to the cut nor will it fill with swarf and pump it from the cut. Therefore, at least when one's objective is to use as little diamond bearing material as possible, I prefer angle B equal approximately 70°. If the blade is used in such a manner that one particular side face of each gullet is always the leading side face into the cutting area, then perhaps the angle of the opposing or trailing side face is of little importance. This is because in addition to the positive displacement type pumping action of the blade, it is believed that dynamic action is imparted to coolant by the leading side face of the blade gullet and as such it is the angle of this side face which will be most influential on the cooling and flushing action in the area of the cut. However, since blades of this general type are at times mounted on the arbor without regard to which side of the blade may be outboard of the drive means, I prefer the gullet be symmetrical so that either side face will function effectively to produce the desired pumping action on the fluid coolant used to cool the blade and flush the swarf from the cutting area.

A drill hole 24 is made approximately at the centerpoint of the apex of each gullet 16 for purposes of relieving stresses which would otherwise be created at a sharp juncture of the side faces 20,22.

In addition to the geometry of the gullet, a second important criteria to the effective performance of my invention is that the total peripheral or circumferential length of diamond bearing material, i.e. the total length of all members 18 should be approximately equal to, and preferably slightly greater than, the total gullet arc length or circumferential width at the extremities of the wheel. Thus there is afforded a balance between the cutting ability of the diamond bearing members and the volumetric capacity of the gullets and thus their ability to cool the blade and carry away the swarf. I prefer the cutting member arc length L of each cutting member be approximately equal to the arc length l of each gullet. However, an acceptable approximate range for the ratio of cutting member arc length to gullet arc length is 0.75 to 1.20 or, conversely, the ratio of gullet arc length to cutting member arc length is at least around 0.83 to 1.33.

A specific example of my preferred embodiment is a cutting wheel having the following specifications:

Blade core diameter: 24 inches
Blade core material: Steel
Blade core thickness: 0.130 inches
Number of cutting members: 19, equally spaced
Cutting member arc length (L): 2.0 inches
Number of gullets: 19
Gullet arc length (l): Approx. 1.97 inches (this exact dimension is determined by the other parameters given in this example)
Gullet included angle B: 70°
Gullet angle A: 35°. The radial depth of the gullet is at least around 0.7 of the gullet arc length
Stress relieving drill hole radius: 5/16 inch The end result of a blade constructed as above-described in accordance with my preferred embodiment is a blade wherein the gullet (i) provides a substantial entrapment of a fluid coolant within the plane of the blade; (ii) pumps the fluid coolant into and from the cutting area; (iii) exposes a substantial amount of the core to the coolant; and (iv) carrys away the swarf from the cutting area each time it passes through the cut. Using the preferred dimensions specified above, the area of each gullet can be calculated to be approximately 1.4 in.$^2$.

Figure 3:
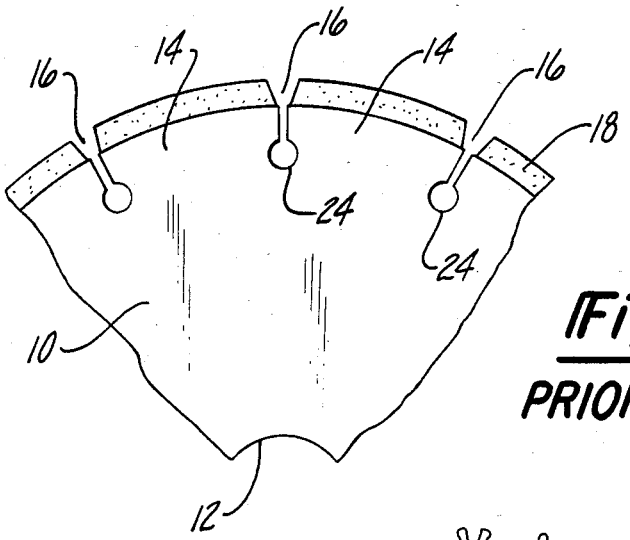
Fig-3 PRIOR ART
FIG. 3 is a fragmentary face view of a cutting wheel according to one example of the prior art.

As shown in FIG. 3 wherein like references are used to refer to like features shown in FIGS. 1 and 2, prior art blades include the usual diamond-bearing cutting members 16 mounted upon respective bases of cutting segments 14. These blades are commonly slotted as at 16. However, the slots serve the primary purpose of providing a means for relieving thermal stresses caused during the manufacturing step of bonding each of the diamond-bearing cutting members to the core. As such they have heretofore not been constructed to provide the advantages obtained with the gullets of my invention.

Figure 4:
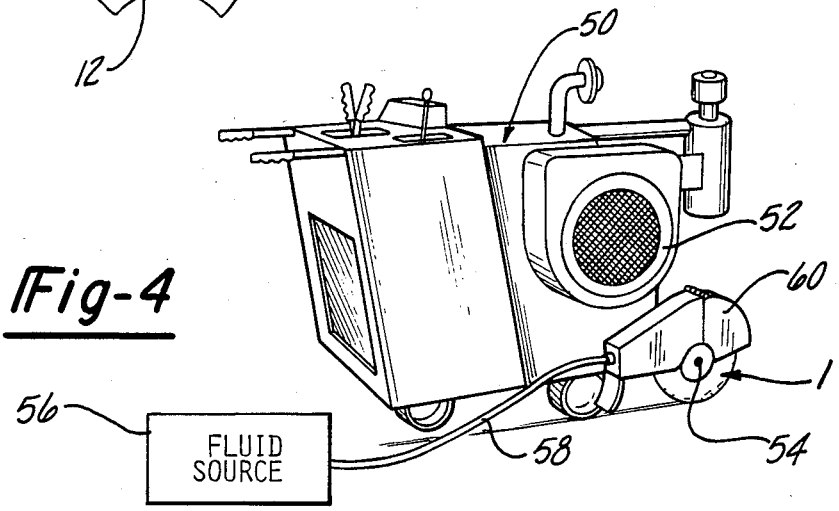
FIG. 4 is a generally schematic perspective view of the cutting system according to a preferred embodiment of the invention.

In use, as shown in FIG. 4, the cutting wheel 1 of my invention is mounted on the drive arbor shaft of a saw 50. The saw includes a motor generally shown at 52 for driving an arbor shaft 54 and thus the blade 1. It also includes means shown schmatically at 56 for continuously providing a fluid coolant under constant pressure to the blade cutting area via a hose 58 leading to the blade shroud 60. The saw 50 by itself as shown and described is of standard construction and forms no part of my invention. However, as a result of the unique structure of the cutting wheel blade 1 itself, upon supplying coolant to the cutting area during the process of cutting an abradable rock material, each gullet 16 in effect renders a pumping action to the coolant in the cutting area in the manner as elsewhere described herein. This includes entrapping the fluid coolant within each gullet as each such gullet enters the immediate area of the cut, i.e. the leading end of the groove being cut, and carrying the coolant from the surface of the material to that area. Thereafter each gullet as it passes from the leading end of the groove being cut entraps the swarf and carrys it away from this area. On at least certain applications, it is believed the coolant and/or swarf will be caused to flow radially inwardly into a respective gullet, thus keeping the cut or groove clean of abraded material and providing a greater cooling effect to the core and the diamond-bearing cutting members.

It is to be understood that the aforedescribed preferred embodiment is not limiting but is merely illustrative of the invention, and various modifications thereof may be made by one skilled in the art without departing from the spirit and scope of the invention as defined by the appended claims.

I claim:

1. A rotatable cutting wheel for wet cutting of rock or rock-like material comprising:

a circular generally disc-shaped drive core having a plurality of circumferentially extending and circumferentially spaced support surfaces, a substantial number of said support surfaces having affixed thereto an abrasive cutting material means capable of cutting an abradable rock or rock-like material, said core having a plurality of gullets, a substantial number of said gullets extending between a closed gullet end located a substantial radial distance inwardly of said support surfaces and an open gullet end defined by the space between adjacent pairs of said support surfaces, the ratio of the circumferential width of said open gullet end to said circumferential length of each of said adjacent pair of said support surfaces being in the range of approximately 0.83 to 1.33, the total circumferential length of said support surfaces being approximately equal to the total circumferential width of all of said gullets at the open ends thereof, and the radial distance between the open and closed ends of each said gullet being at least around 0.7 of said circumferential width of the corresponding open gullet end, whereby each of said gullets and the respective open gullet end cooperate to define a fluid passageway having a substantial volumetric capacity through which a fluid coolant can be circulated in substantial amounts to the cutting area, cool the drive core in the area immediately adjacent the abrasive cutting material means and carry away swarf therefrom.

2. A rotatable cutting wheel according to claim 1, wherein each of said support surfaces is approximately two inches in circumferential length.

3. A rotatable cutting wheel according to claim 2, wherein the circumferential width of each said gullet decreases substantially from said open gullet end to said closed gullet end.

4. A rotatable cutting wheel according to claim 1, wherein said abrasive cutting material means include diamond particles held by and dispersed throughout a matrix material.

5. A rotatable cutting wheel according to claim 4, wherein said abrasive cutting material means comprises a plurality of separate cutting segments, one of said cutting segments being bonded to each of said support surfaces.

6. A rotatable cutting wheel according to claim 5, wherein each said cutting segment is approximately two inches in circumferential length and the width thereof being slightly greater than that of said drive core at said support surfaces, each of said cutting segment being axially centered on a respective one of said support surfaces so as to extend axially outwardly beyond said drive core by a substantially equal amount at either side thereof.

7. A rotatable cutting wheel according to claim 6, wherein the said radial distance between the open and closed ends of each of said gullets is determined as extending from the radially outermost extremity of said open gullet end to a point defined as the intersection of two lines, each of said two lines diverging radially inwardly from a respective, adjacent support surface at an equal angle relative to a line extending radially outwardly from the center of said core through the circumferential center of said open gullet end, said two lines intersecting at an included angle of approximately 70°.

8. A rotatable cutting wheel according to claim 6, wherein each of said gullets begins at a apex radially inwardly of the periphery of said drive core and is bounded by a pair of side faces diverging radially outwardly from said apex to an included angle greater than zero degrees and less than approximately 90°.

9. A rotatable cutting wheel according to claim 8, wherein said pair of side faces of each of said gullets diverge radially outwardly for at least a major portion thereof at an included angle of approximately 70°.

10. A rotatable cutting wheel according to claim 9, wherein each of said gullets is symmetrical to a line radiating from the center of said core through said apex.

11. A rotatable cutting wheel according to claim 10, further including relief means at each of said apexes for relieving tensile stress at the apex of each of said gullets, said relief means comprising a drill hole having a centerpoint located substantially at the apex of each of said gullets.

12. In combination, a machine for cutting natural and artificial rock or rock-like material including a rotary abrasive cutting means, means for rotating said cutting means and means for supplying a liquid coolant to said cutting means for purposes of cooling the cutting means and carrying away loose rock material from the cutting edges thereof, said cutting means including at least one circular generally disc-shaped drive core, said drive core having a plurality of circumferentially extending and circumferentially spaced support surfaces, each of said support surfaces having affixed thereto for at least a substantial portion of the circumferential length thereof an abrasive cutting material means capable of cutting an abradable rock or rock-like material, said core having a plurality of gullets, a substantial number of said gullets extending between a closed gullet end located a substantial radial distance inwardly of said support surfaces and an open gullet end defined by the space between adjacent pairs of said support surfaces.

the ratio of the circumferential width of said open gullet end to said circumferential length of said adjacent support surfaces being in the range of approximately 0.83 to 1.33, and the radial distance between the open and closed ends of each said gullets being at least around 0.7 of said circumferential width of each of said open gullet ends, whereby each of said gullets and the respective open gullet end cooperate to define a fluid passageway having a substantial volumetric capacity through which a fluid coolant can be circulated in substantial amounts to the cutting area, cool the drive core in the area immediately adjacent the abrasive cutting material means and carry away swarf therefrom.

13. The combination according to claim 12, wherein said abrasive cutting material means includes diamond particles held by and dispersed throughout a matrix material.

14. The combination according to claim 13, wherein said abrasive cutting material means comprises a plurality of separate cutting segments, one of said cutting segments being bonded to each of said support surfaces.

15. The combination according to claim 14, wherein each said cutting segment is approximately two inches in circumferential length and the width thereof being slightly greater than that of said drive core at said support surfaces, each of said cutting segment being axially centered on a respective one of said support surfaces so as to extend axially outwardly beyond said drive core by a substantially equal amount at either side thereof.

16. A rotatable cutting wheel according to claim 4, wherein said circumferential width of said gullet at the open end thereof is approximately two inches.

17. A rotatable cutting wheel according to claim 5, wherein all of said cutting segments are approximately two inches in circumferential length, and said ratio of said circumferential width of each said gullet at the open end thereof to said circumferential length of each of said adjacent pair of said support surfaces is approximately one.

18. The combination according to claim 13, wherein said circumferential width of said gullet at the open end thereof is approximately two inches.

19. The combination according to claim 14, wherein each of said support surfaces is approximately two inches in circumferential length, each of said cutting segments also being approximately two inches in circumferential length, and said ratio of said circumferential width of each of said gullets at the open end thereof to said circumferential length of each of said adjacent pair of said support surfaces being approximately one.

20. The combination according to claim 19, wherein each of said gullets begins at an apex radially inwardly of the periphery of said drive core and is bounded by a pair of side faces diverging radially outwardly from said apex for at least a major portion thereof at an included angle of approximately 70°.

21. A rotatable cutting wheel for wet cutting of rock or rock-like material comprising:

a circular generally disc-shaped drive core having a plurality of circumferentially extending and circumferentially spaced support surfaces, a substantial number of said support surfaces being at least approximately two inches in circumferential length and having affixed thereto for at least a substantial portion of the circumferential length thereof an abrasive cutting material means capable of cutting an abradable rock or rock-like material, said core having a plurality of gullets, a substantial number of said gullets extending between a closed gullet end located a substantial radial distance inwardly of said support surfaces and an open gullet end defined by the space between adjacent pairs of said support surfaces, the ratio of the circumferential width of said open gullet end to said circumferential length of each of said adjacent pair of said support surfaces being in the range of approximately 0.83 to 1.33, and the radial distance between the open and closed ends of each said gullet being at least around 0.7 of said circumferential width of the corresponding open gullet end, whereby each of said gullets and the respective open gullet end cooperate to define a fluid passageway having a substantial volumetric capacity through which a fluid coolant can be circulated in substantial amounts to the cutting area, cool the drive core in the area immediately adjacent the abrasive cutting material means and carry away swarf therefrom.

22. A rotatable cutting wheel for wet cutting of rock or rock-like material comprising:

a circular generally disc-shaped drive core having a plurality of circumferentially extending and circumferentially spaced support surfaces, each of said support surfaces having affixed thereto for substantially the full circumferential length thereof an abrasive cutting material means capable of cutting an abradable rock or rock-like material, said core having a plurality of gullets, each said gullet therein defined by the space between each adjacent pair of said support surfaces, said gullet extending between a closed gullet end located a substantial radial distance inwardly of said support surfaces and an open gullet end being in communication with the space between said adjacent pair of said support surfaces, the circumferential width of said open gullet end being coextensive with the circumferential length of said space, the total circumferential length of said support surfaces being approximately equal to the total circumferential width of said gullets at the open end thereof, and the radial distance between the open end and closed ends of each of said gullet closely approximating the circumferential width of each said open gullet end, said gullet defining an area between said adjacent pair of support surfaces of approximately 1.4 square inches, whereby each said gullet and a respective said space cooperate to define a fluid passageway having a substantial volumetric capacity through which a fluid coolant can be circulated in substantial amounts to the cutting area to cool the drive core in the area immediately adjacent the abrasive cutting material means and to carry away swarf therefrom.

* * * * *

UNITED STATES PATENT AND TRADEMARK OFFICE

CERTIFICATE OF CORRECTION

PATENT NO. : 4,583,515

DATED : April 22, 1986

INVENTOR(S) : Paul B. Ballenger

It is certified that error appears in the above-identified patent and that said Letters Patent is hereby corrected as shown below:

Column 2, line 50, after "materials" delete "." and insert ",".

Column 7, line 55, after "surfaces" delete "." and insert ",".

Signed and Sealed this

Fourth Day of November, 1986

[SEAL]

*Attest:*

DONALD J. QUIGG

*Attesting Officer*

*Commissioner of Patents and Trademarks*